US011833528B2

(12) United States Patent
Tronrud et al.

(10) Patent No.: US 11,833,528 B2
(45) Date of Patent: Dec. 5, 2023

(54) CENTRIFUGE APPARATUS FOR A PROCESSING CARTRIDGE HAVING A ROTARY PLATE AND A STOPPING ELEMENT

(71) Applicant: SpinChip Diagnostics AS, Oslo (NO)

(72) Inventors: Ole Christian Tronrud, Sokna (NO); Sebastian Stenmark, Oslo (NO); Rolf Jahren, Oslo (NO); Torgeir Hamsund, Oslo (NO); Stig Morten Borch, Oslo (NO)

(73) Assignee: SpinChip Diagnostics AS, Oslo (NO)

( * ) Notice: Subject to any disclaimer, the term of this patent is extended or adjusted under 35 U.S.C. 154(b) by 653 days.

(21) Appl. No.: 16/761,439

(22) PCT Filed: Sep. 20, 2018

(86) PCT No.: PCT/EP2018/075435

§ 371 (c)(1),
(2) Date: May 4, 2020

(87) PCT Pub. No.: WO2019/091650

PCT Pub. Date: May 16, 2019

(65) Prior Publication Data

US 2020/0391227 A1 Dec. 17, 2020

(30) Foreign Application Priority Data

Nov. 9, 2017 (NO) ..... 20171776

(51) Int. Cl.
*B04B 5/02* (2006.01)
*B04B 7/00* (2006.01)
*B04B 9/12* (2006.01)

(52) U.S. Cl.
CPC ..... *B04B 5/02* (2013.01); *B04B 7/00* (2013.01); *B04B 9/12* (2013.01)

(58) Field of Classification Search
CPC ..... B04B 5/02; B04B 7/00; B04B 9/12
(Continued)

(56) References Cited

U.S. PATENT DOCUMENTS 4,814,282 A 3/1989 Holen et al.
4,820,106 A * 4/1989 Walde ..... H01L 21/6715 414/217

(Continued)

FOREIGN PATENT DOCUMENTS

CN 106573256 A 4/2017
CN 206262704 U 6/2017

(Continued)

OTHER PUBLICATIONS

Notification of the First Office Action dated May 8, 2021, directed to CN Application No. 201880072737.0; 13 pages.

(Continued)

*Primary Examiner* — Walter D. Griffin
*Assistant Examiner* — Shuyi S. Liu
(74) *Attorney, Agent, or Firm* — Morrison & Foerster LLP

(57) ABSTRACT

Provided is a centrifuge apparatus for a processing cartridge, including a rotary plate and at least one cartridge holder, and the cartridge holder is rotatable around its centre axis and arranged off-centre the centre axis of the rotary plate and comprises an inner side wall surrounding a through-going passage, wherein the through-going passage is able to accommodate the processing cartridge; and the inner side wall includes a resilient locking assembly for interaction with at least one cooperating first abutting surface on the processing cartridge, such that the processing cartridge may be inserted into the through-going passage and releasably secured by the locking assembly; and at least one stopping element for interaction with at least one cooperating second (Continued)

abutting surface on the processing cartridge, the at least one stopping element being arranged to retain the processing cartridge at a desired vertical level when the cartridge is releasably secured.

16 Claims, 5 Drawing Sheets

(58) Field of Classification Search
USPC ..... 494/31, 33
See application file for complete search history.

(56) References Cited

U.S. PATENT DOCUMENTS

| | | | | |
|---|---|---|---|---|
| 5,035,861 | A * | 7/1991 | Grandone | B01L 3/5025 422/65 |
| 6,593,143 | B1 | 7/2003 | Gordon | |
| 2001/0051377 | A1 | 12/2001 | Hammer et al. | |
| 2006/0083667 | A1 | 4/2006 | Kohara et al. | |
| 2009/0111675 | A1 | 4/2009 | Yokogawa et al. | |
| 2012/0301972 | A1 * | 11/2012 | Borch | B04B 9/10 422/533 |
| 2017/0348653 | A1 | 12/2017 | Dobos et al. | |
| 2018/0093270 | A1 | 4/2018 | Ladtkow et al. | |

FOREIGN PATENT DOCUMENTS

| | | | |
|---|---|---|---|
| CN | 107206397 | A | 9/2017 |
| CN | 106461655 | B | 5/2018 |
| CN | 108348929 | A | 7/2018 |
| DE | 102015100004 | A1 | 7/2016 |
| EP | 0160901 | A2 | 11/1985 |
| EP | 1873529 | A2 | 1/2008 |
| JP | 2009-58424 | A | 3/2009 |
| JP | 2009058424 | A * | 3/2009 |
| WO | 03/083491 | A2 | 10/2003 |
| WO | 2011/081521 | A1 | 7/2011 |
| WO | 2011/081530 | A1 | 7/2011 |
| WO | 2011/081531 | A1 | 7/2011 |
| WO | 2015/193471 | A1 | 12/2015 |
| WO | 2015/193474 | A1 | 12/2015 |
| WO | 2015/193478 | A1 | 12/2015 |
| WO | 2016/107704 | A1 | 7/2016 |
| WO | 2016/113023 | A1 | 7/2016 |

OTHER PUBLICATIONS

Notification of Grant of Patent for Invention dated Jan. 6, 2022, directed to CN Application No. 201880072737.0; 7 pages.
International Search Report and Written Opinion dated Dec. 19, 2018, directed to PCT Application No. PCT/EP2018/075435; 11 pages.
Norwegian Search Report dated Apr. 14, 2018, directed to NO Application No. 20171776; 2 pages.
Notice of Reasons for Rejection dated Oct. 11, 2022, directed to JP Application No. 2020-525910; 7 pages.

* cited by examiner

CENTRIFUGE APPARATUS FOR A PROCESSING CARTRIDGE HAVING A ROTARY PLATE AND A STOPPING ELEMENT

CROSS-REFERENCE TO RELATED APPLICATIONS

This application is a U.S. National Phase patent application of PCT/EP2018/075435, filed Sep. 20, 2018, which claims priority to Norwegian Patent Application No. 20171776, filed Nov. 9, 2017, the entire contents of each of which are incorporated herein by reference.

FIELD OF THE DISCLOSURE

The present invention relates to the field of centrifuge apparatuses for processing cartridges, more specifically a dual axis centrifuge and a processing cartridge for such a centrifuge.

BACKGROUND OF THE DISCLOSURE

Centrifugation as a mean for accelerating sedimentation of cells, particles and precipitates as well as for separation of liquids or cells with different density has long been an integral part of chemical and biochemical protocols. The use of centrifugation for running chemical reactions and assays in microfluidic circuits arranged in cartridges or chips is common. In most of these instances the direction of the centrifugal force applied to the microfluidic circuit is constant, and centrifuges similar to a compact disc (CD) player, wherein the microfluidic circuit is arranged in a CD-shaped chip or cartridge, are often used.

The use of dual axis centrifugation as disclosed in for instance WO 2011/081531, provides a more flexible and faster means of performing processing in a microfluidic circuit. However, due to the requirement of being able to rotate the chip relative a secondary axis, a centrifuge apparatus based on the CD-player principle is not feasible.

The U.S. Pat. No. 4,814,282 (Holen et al.) discloses a dual axis centrifuge apparatus including a circular plate which is mounted on a vertical axis for rotation about the axis. The plate is driven by an electric motor. Mounted on the plate are two sample processor card holders, each adapted to receive a sample processor card. Each card holder is in the nature of a tray and is rotatably mounted relative to the plate on an axis operatively connected to a separate drive means to rotate the card holder. The sample processor card is arranged and secured in the card holder by manually placing the card into the holder and securing it by finger-like projections arranged at the periphery of the tray.

US 2006/083667 A1 (Kohara et al.) discloses a chemical reaction device and a chemical reaction apparatus supposedly capable of performing transverse liquid movement in a simple structure and at low cost without causing contamination and air bubbles. There is installed a mechanism for supporting the chemical reaction device in any other position than a centre of a turntable which can be rotated, for moving liquid by a centrifugal force due to rotation, and for reversing a direction of the flow path independently of the turntable.

EP 1873529 A2 (Kaisha) discloses a microchip testing device having a dual axis system for imparting a variable centrifugal force to a microchip. The microchip is manually arranged in a chip holder. The chip holder is formed as an open box shaped part with a closable cover for securing the microchip.

WO 2011/081531 (Borch et al.) A1 discloses a dual axis centrifugation apparatus for a sample processing device. The sample processing device is arranged in holding means in a rotatable plate. The holding means are disclosed as a rotating bay or compartment in which the sample processing device may be arranged.

None of the prior art discloses a dual axis centrifugation apparatus suitable for automatic insertion of a processing cartridge into a cartridge holder.

It is an object of the present disclosure to provide a dual axis centrifugation apparatus having a cartridge holder in which a processing cartridge may be releasably secured and kept/held at a predetermined vertical level during processing.

SUMMARY OF THE DISCLOSURE

Embodiment of the present invention are defined by the appended claims and in the following:

In some embodiments, a centrifuge apparatus for a processing cartridge is provided, comprising a rotary plate being rotatable around its centre axis and comprising at least one cartridge holder, wherein the rotary plate has an upper face and a lower face, and the cartridge holder is rotatable around its centre axis and arranged off-centre the centre axis of the rotary plate and comprises an inner side wall surrounding a through-going passage, wherein the through-going passage is able to accommodate the processing cartridge and extends from the upper face to the lower face of the rotary plate (i.e. the passage has a first end at the upper face of the rotary plate and a second end at the lower face of the rotary plate); and the inner side wall comprises a resilient locking assembly for interaction with at least one cooperating first abutting surface on the processing cartridge, such that the processing cartridge may be inserted into the through-going passage and releasably secured by the locking assembly, and at least one stopping element for interaction with at least one cooperating second abutting surface on the processing cartridge, the at least one stopping element is arranged to retain the processing cartridge (i.e. the upper or lower face of the processing cartridge) at a desired vertical level/horizontal plane when the cartridge is releasably secured (i.e. the at least one stopping element is arranged to hold an upper or lower face of the sample processing cartridge at a desired level. Thus, ensuring that the upper or lower face of the cartridge is parallel to the rotational plane of the rotary plate).

In some embodiments of the centrifuge apparatus, the inner side wall comprises at least one of a vertical rib or recess for interaction with a cooperating recess or vertical rib, respectively, arranged at a circumferential side wall of the processing cartridge, such that the processing cartridge may only be introduced into the cartridge holder at a specific rotational direction relative a centre axis of the cartridge holder.

The locking assembly comprises a locking assembly surface for interaction with the at least one cooperating first abutting surface on the processing cartridge, at least parts of the locking assembly surface faces in a direction towards the first abutting surface. The stopping element comprises a stopping element surface for interaction with the at least one cooperating second abutting surface on the processing cartridge, at least parts of the stopping element surface faces in a direction towards the second abutting surface.

In some embodiments of the centrifuge apparatus, the resilient locking assembly is for interaction with the first abutting surface when the first abutting surface is arranged on a circumferential side wall of the processing cartridge.

In some embodiments of the centrifuge apparatus, the stopping element is for interaction with the second abutting surface when the second abutting surface is arranged on a circumferential side wall of the processing cartridge.

In some embodiments of the centrifuge apparatus, the resilient locking assembly is arranged to push/force an accommodated processing cartridge against the at least one stopping element. In some embodiments, the resilient locking assembly is arranged to push/force an accommodated processing cartridge in a vertical direction, preferably in an upwards direction.

In some embodiments of the centrifuge apparatus, the resilient locking assembly is arranged to provide a locking force to an accommodated processing cartridge, the locking force holding the processing cartridge against the at least one stopping element. In some embodiments, the locking force is in a substantially upwards direction.

In some embodiments of the centrifuge apparatus, the resilient locking assembly is pretensioned/biased towards a locking position, in which position an accommodated processing cartridge may be releasably secured.

In some embodiments of the centrifuge apparatus, the resilient locking assembly comprises multiple resilient elements spaced around the inner side wall, preferably evenly spaced around the inner side wall. In some embodiments, each of the resilient elements is preferably a pretensioned/preloaded ball arranged in, or at, the inner side wall. Each ball or element may be pretensioned by any type of spring arranged to push the ball or element against a first abutting surface on the processing cartridge.

In some embodiments of the centrifuge apparatus, the at least one stopping element comprises a recess in the inner side wall of the cartridge holder, wherein the recess extends from an edge portion of the side wall and one end of the recess being distal from the edge portion is for interaction with the second abutting surface, preferably the at least one stopping element comprises at least two of said recesses spaced around the inner side wall.

In some embodiments of the centrifuge apparatus the inner side wall comprises a vertical rib, for interaction with a cooperating recess arranged at the circumferential side wall of the processing cartridge, and the at least one stopping element comprises a recess in the vertical rib for interaction with the second abutting surface.

In some embodiments of the centrifuge apparatus, at least a first cartridge holder element comprising the inner wall of the cartridge holder is slidably connected to the rotary plate via a bearing assembly, such that the inner wall may rotate around the centre axis of the cartridge holder, preferably the bearing assembly is a ball bearing assembly.

In some embodiments of the centrifuge apparatus, the cartridge holder is arranged such that the processing cartridge may enter the through-going passage from the lower face of the rotary plate, during use.

In some embodiments of the centrifuge apparatus, the centrifuge apparatus comprises a cartridge loading tray, a cartridge loading piston for loading the processing cartridge into the at least one cartridge holder and a cartridge ejection piston for ejecting the processing cartridge out of the cartridge holder. In some embodiments, the loading and ejection pistons are coaxially arranged on opposite sides of the cartridge loading tray and the rotary plate and may optionally be controlled by a camshaft assembly.

In some embodiments of the centrifuge apparatus, the centrifuge apparatus comprises at least one motor for controlling the rotation of the rotary plate and the at least one cartridge holder.

In some embodiments of the centrifuge apparatus, the centrifuge apparatus comprises an optical system for control, detection and/or analysis of a process performed in the processing cartridge.

In some embodiments, the present disclosure provides a processing cartridge for a centrifuge apparatus, comprising an upper face, a lower face and a circumferential side wall, the circumferential side wall comprises at least one first abutting surface facing away from the upper face. In some embodiments, the first abutting surface is part of a section of the circumferential side wall being angled/inclined relative to the centre axis of the cartridge (i.e. the first abutting surface face away from the upper face of the processing cartridge, such that a force applied to the first abutting surface by the resilient locking assembly will push/force the cartridge against the at least one stopping element).

The processing cartridge may comprise a single first abutting surface extending around a major part of the circumferential side wall or comprise at least two, or at least three, separate first abutting surfaces arranged along the circumferential side wall.

The upper and lower face of the processing cartridge may also be termed a first and second face, respectively, which are preferably parallel.

In some embodiments of the processing cartridge, the circumferential side wall comprises at least one second abutting surface facing away from the lower face. In some embodiments, the at least one second abutting surface is arranged on at least one rib/protrusion arranged at the circumferential side wall, preferably on at least two or at least three spaced ribs/protrusions. The ribs/protrusions may be evenly space around the circumferential side wall. The second abutting surface may be perpendicular to the centre axis of the processing cartridge.

In some embodiments of the processing cartridge, the circumferential side wall comprises a recess extending from the lower face to the upper face. In some embodiments, the recess comprises a shoulder element providing a second abutting surface.

In some embodiments, the processing cartridge comprises a second abutting surface arranged on each of two rib/protrusion arranged at the circumferential side wall and a second abutting surface arranged on the shoulder element of the recess extending from the lower face to the upper face.

In some embodiments of the processing cartridge, the upper face, the lower face and the circumferential side wall defines a disc-shaped body (i.e. the circumferential side wall is substantially circular).

In some embodiments of the processing cartridge, an internal volume of the cartridge comprises a microfluidic processing circuit.

In some embodiments, the present disclosure provides a processing system comprising a centrifuge apparatus.

In some embodiments of the processing system, the upper face of the rotary plate is at a higher vertical level than the upper face of the processing cartridge, when the processing cartridge is releasably secured in the cartridge holder.

In some embodiments, the present disclosure provides a method of loading a processing cartridge into a centrifuge apparatus comprising a cartridge loading tray and a cartridge loading piston, the method comprises the steps of loading a processing cartridge, preferably a processing cartridge, into the cartridge loading tray; moving the cartridge loading tray, such that the centreline of the processing cartridge is in line with the centreline of the cartridge holder; and moving the cartridge loading piston in a vertical direction, such that the processing cartridge is pushed into the at least one cartridge holder, such that the processing cartridge is releasably secured in the cartridge holder.

In some embodiments of the method, the cartridge loading piston is moved in an upwards vertical direction, such that the processing cartridge is pushed into the at least one cartridge holder from below.

The term "processing cartridge" is intended to mean a chip/cartridge comprising an internal fluid circuit suitable for performing analysis, assays etc. on a suitable sample introduced into the cartridge, as well as performing various types of chemical reactions, such as polymerase chain reaction (PCR) and synthetic chemistry reactions.

The term "resilient locking assembly" is intended to mean any suitable resilient locking device able to releasably secure a processing cartridge, preferably by applying an elastic force.

The term "resilient element" is intended to define any suitable element which may provide an elastic force to an interacting device or surface. In the present specification, a resilient element is an element able to provide a force, preferably an elastic force, to the first abutting surface of a processing cartridge.

The term "releasably secured" is intended to mean that the processing cartridge is secured such that it may be released by applying a force to the processing cartridge sufficient to overcome the elastic force applied to the processing cartridge by the resilient locking assembly.

The term "first abutting surface" may also be termed a locking surface, the "second abutting surface" may also be termed a stopping surface. Each of the first and second abutting surface may be a single continuous surface or multiple separate surfaces.

The term "processing system" is meant to define a system suitable for performing analysis, assays etc. on a suitable sample introduced into a processing cartridge, as well as performing various types of chemical reactions, such as polymerase chain reaction (PCR) and synthetic chemistry reactions within a processing cartridge.

BRIEF DESCRIPTION OF THE FIGURES

Embodiments of the invention will now be described in greater detail by way of example only and with reference to the following drawings.

DETAILED DESCRIPTION OF THE DISCLOSURE

Figure 1:
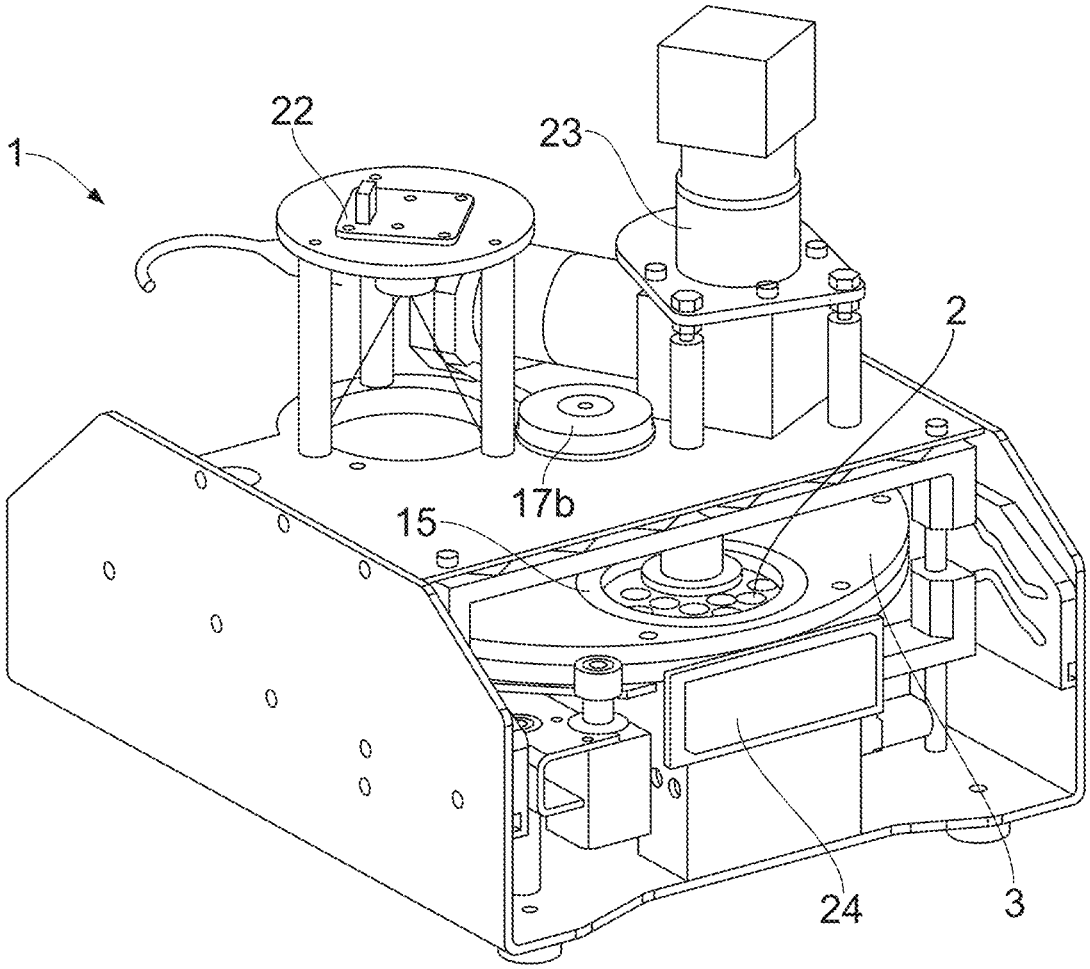
FIG. 1 is a perspective view of some embodiments of the centrifuge apparatus, according to some embodiments.

A perspective view of an exemplary centrifuge apparatus 1 according to the disclosure is shown in FIG. 1. Further views of the centrifuge apparatus, wherein certain elements have been removed for illustrative purposes, are shown in FIGS. 2 and 3.

The centrifuge apparatus 1 may be used for liquid processing and flow control within microchips or cartridges used for analytical assays, chemical processing etc. The microchips or cartridges are in the present specification commonly termed as processing cartridges. By use of the present centrifuge apparatus, controlled processing of fluidic elements in at least two dimensions may be performed.

Figure 2:
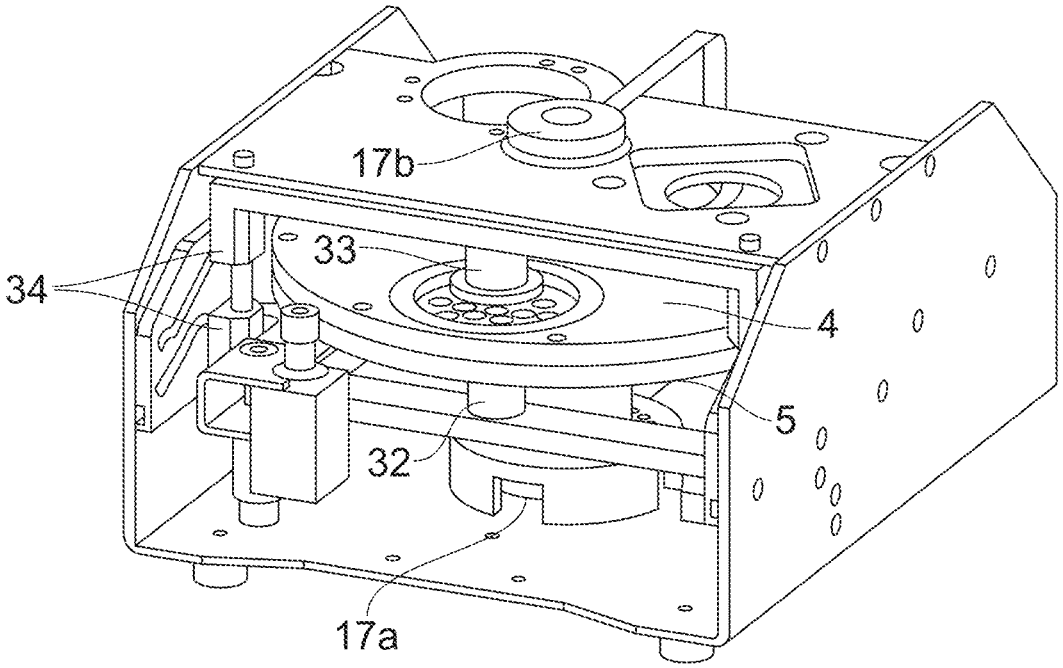
FIG. 2 is a perspective view of the centrifuge apparatus in FIG. 1, wherein the light and optics assembly is removed, according to some embodiments.
Figure 3:
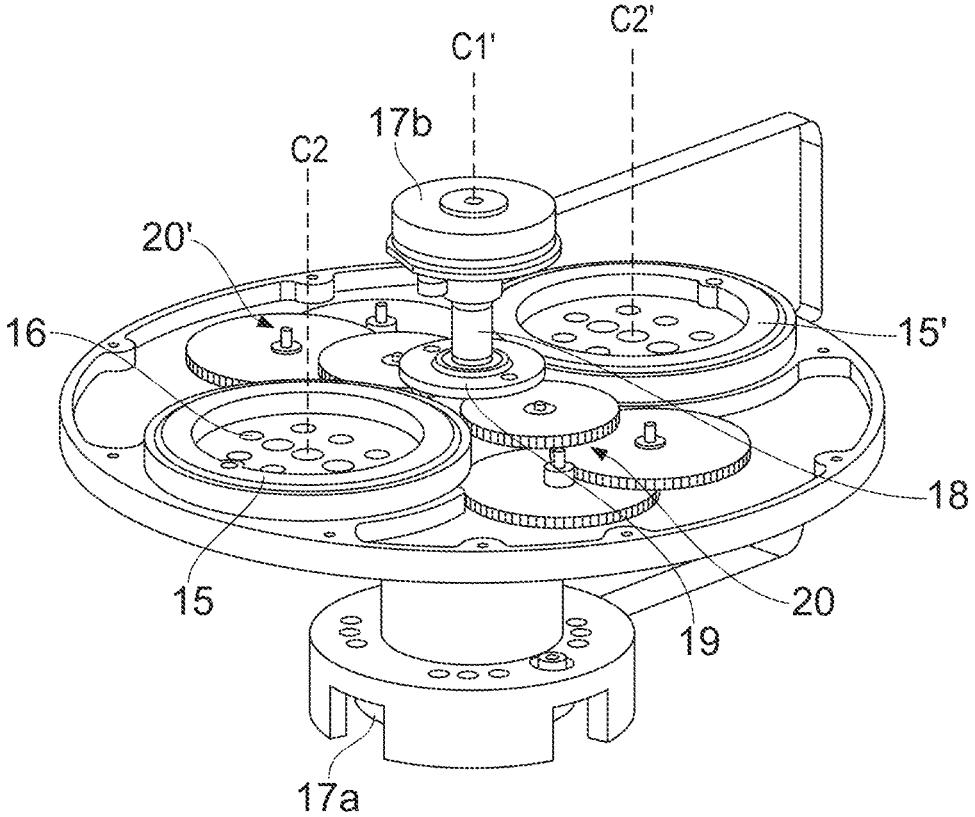
FIG. 3 is a perspective view of the rotary assembly of the centrifuge apparatus in FIGS. 1 and 2, according to some embodiments.
Figure 4:
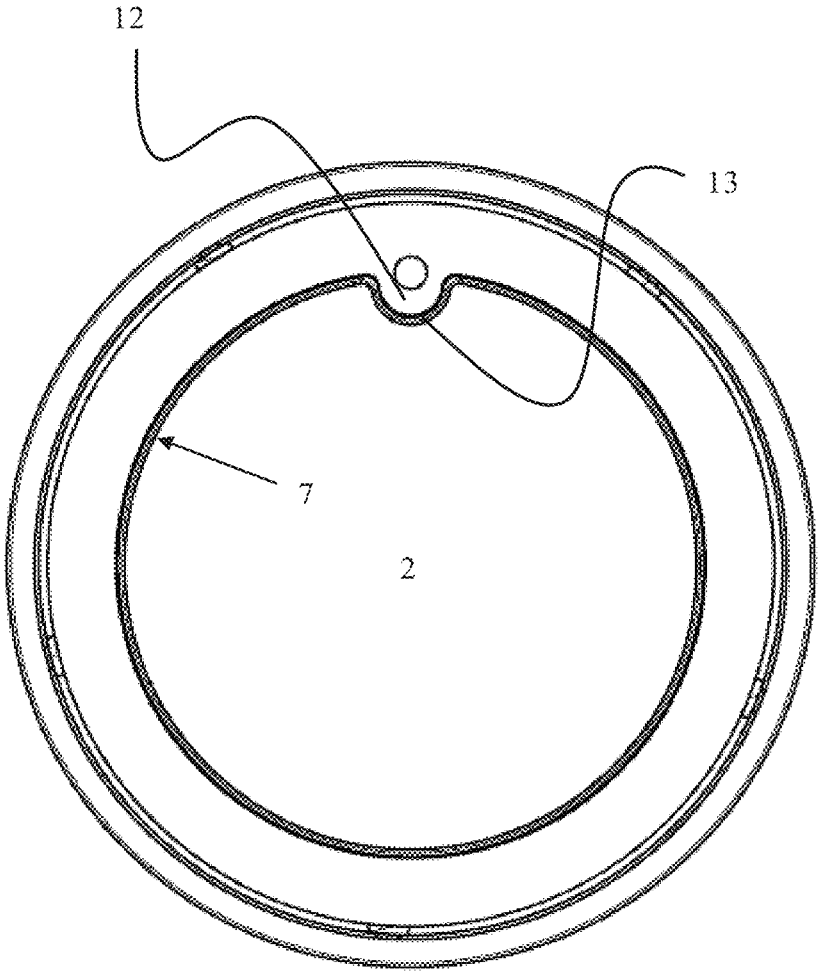
FIG. 4 is a top view of the cartridge holder of the centrifugal apparatus in FIGS. 1 and 2, comprising a releasably secured processing cartridge, according to some embodiments.
Figure 5:
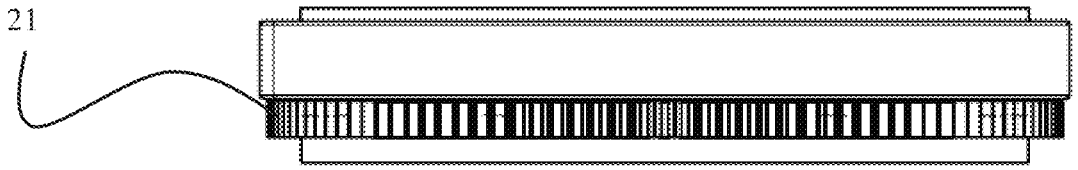
FIG. 5 is a side view of the cartridge holder in FIG. 4, according to some embodiments.

With reference to FIGS. 1-3, the centrifuge apparatus 1 comprises a horizontally arranged rotary plate 3. The rotary plate 3 has an upper face 4 and a lower face 5 and is adapted to be rotated about a first vertical axis C1 which intersects through the centre of the plate 3 (i.e. the centre axis of the plate).

The centrifuge apparatus 1 further comprises two cartridge holders 15,15'. The cartridge holders are arranged in the rotary plate 3 and are symmetrically placed on opposite sides of the first axis C1, as viewed in FIG. 3. Each cartridge holder is arranged to rotate about a respective vertical second axis C2, C2' (i.e. the centre axis of each cartridge holder) and may be rotated both clockwise and counter clockwise about its second axis. Each cartridge holder is adapted to accommodate and releasably secure a processing cartridge 2. When secured in the cartridge holder, the processing cartridges will corotate with the respective cartridge holder about the second axis C2, C2' (and also rotate about the first axis C1 when the rotary plate 3 is turned). Details of the cartridge holder and the external design of the processing cartridge are shown in FIGS. 4-8 and further described below.

The centrifuge apparatus 1 further comprises a first servo-mechanical motor 17*a* and a second servo-mechanical motor 17*b*. Generally, servo-mechanical motors (or servo motors) are representative of motors where exact rotational speed and rotational position may be defined and monitored at any time.

The servo-mechanical motors 17*a*,17*b* at opposite sides/faces of the rotary plate 3. The first motor 17*a* is positioned below the rotary plate 3, while the second motor 17*b* is placed above.

The first motor 17*a* is arranged to rotate the rotary plate 3 about the first axis C1. To this end, the first motor 17*a* may be fixed or rigidly coupled to the rotary plate 3 via a first drive shaft (not shown). The first drive shaft may be a separate shaft or the output shaft of the first motor 17*a*. The first drive shaft is co-axial with the first axis C1. The rotational ratio of the first motor 17*a* to the first drive shaft is here 1:1, i.e. one turn of the motor corresponds to one turn of the shaft.

The second motor 17*b* is adapted to drive or rotate the two cartridge holders 15, 15'. The second motor 17*b* is mechanically connected or coupled to each of the cartridge holders 15, 15', as illustrated in more detail in FIG. 3.

With reference to FIG. 3, the second motor 17*b* has a second drive shaft 18 co-axial with the first axis C1 (and aligned with the first drive shaft). The rotational ratio of the second motor 17*b* to the second drive shaft 18 is here 1:1.

The second drive shaft 18 terminates at the rotary plate 3 with a gear or gear wheel 19. The gear 19 is rigidly coupled to the second drive shaft 18, but not rigidly coupled to the rotary plate 3. The gear 19 is further engaged with two sets of intermediate gear assemblies 20, 20', one set for each cartridge holder. Each of the intermediate gear assemblies 20, 20' is further engaged with a gear 21 or set of teeth (see FIGS. 5-7) arranged on an outer circumference of a respective cartridge holder 15, 15'. The gear ratio between the second motor 17*b* and the gear 21 (or consequently the cartridge holder) may for instance be 72:1, but any suitable ratio is possible.

The centrifuge apparatus may further comprise suitable control means (not shown) for controlling the rotation of the rotary plate 3 and the cartridge holder(s) 15, 15'.

In some embodiments, the centrifuge apparatus comprises a first optical analysis and control system 22 comprising a strobe light source and a camera directed at the rotary plate 3 and the cartridge 2. This is used for monitoring and controlling the centrifugal process for directing various reagents, samples, analytical beads, solvents etc. in the fluid circuit of a cartridge 2.

The centrifuge apparatus also comprises a second optical analysis and control system 23. This system produces a light beam which is directed at the cartridge 2 and is used for analysing a processing result obtained in the fluid circuit of the cartridge. The processing result may for instance be the final product of a chemical reaction, or a set of analytical beads obtained in an assay of a sample, performed in the fluid circuit 16. The optical analysis and control system 23 may further comprise a camera for visualising the geometry of the cartridge 2 for monitoring where on the cartridge 2 the light beam is hitting. This is used for fine tuning the rotation of the rotary plate 3 and the cartridge holder 15 for precise positioning of the cartridge 2 relative to the light beam. Reflected light from the light beam, or light emitted from the processing result in response to the light beam, is examined for determining properties of the processing result.

Alternative and/or additional analysis and control systems are described in for instance WO 2011/081531 (p. 8 line 31-p. 10 line 23), which is incorporated by reference.

The principle solution of obtaining the required rotational movement of the rotary plate and the cartridge holders by use of two coaxial drive shafts, each connected to a separate motor, is disclosed in for instance WO 2011/081521 and U.S. Pat. No. 6,593,143. Although the inventive centrifuge apparatus is described by reference to a specific and preferred design for obtaining the required rotational movement of the rotary plate and the cartridge holder (i.e. two motors having coaxial drive shafts), other solutions would be obvious for the skilled person based on the present disclosure. Such alternative solutions may for instance comprise the use of a first motor for rotating the rotary plate and a separate second motor for each of the cartridge holders. The second motors may for instance be arranged on or inside the rotary plate, preferably symmetrically arranged in relation to the centre axis of the rotary plate.

Details of an advantageous cartridge holder, and a suitable processing cartridge 2, arranged in the rotary plate 3 of the centrifuge apparatus 1 are shown in FIGS. 4-8.

The cartridge holder comprises an inner side wall 7 surrounding a through-going passage 6 extending from the upper face 4 to the lower face 5 of the rotary plate 3. The through-going passage, or at least the end of the passage through which the cartridge is inserted, has a cross-section substantially corresponding to an outer circumference of the processing cartridge 2, such that the passage 6 is able to accommodate the processing cartridge 2.

Figure 6:
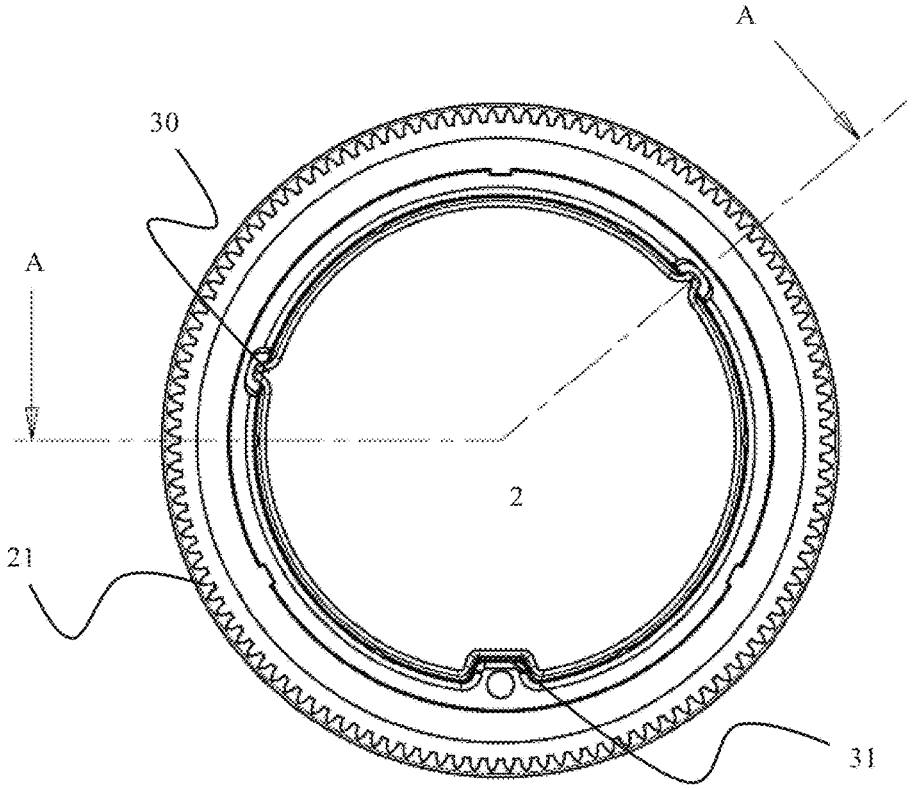
FIG. 6 is a bottom view of the cartridge holder in FIG. 4, according to some embodiments.
Figure 7:
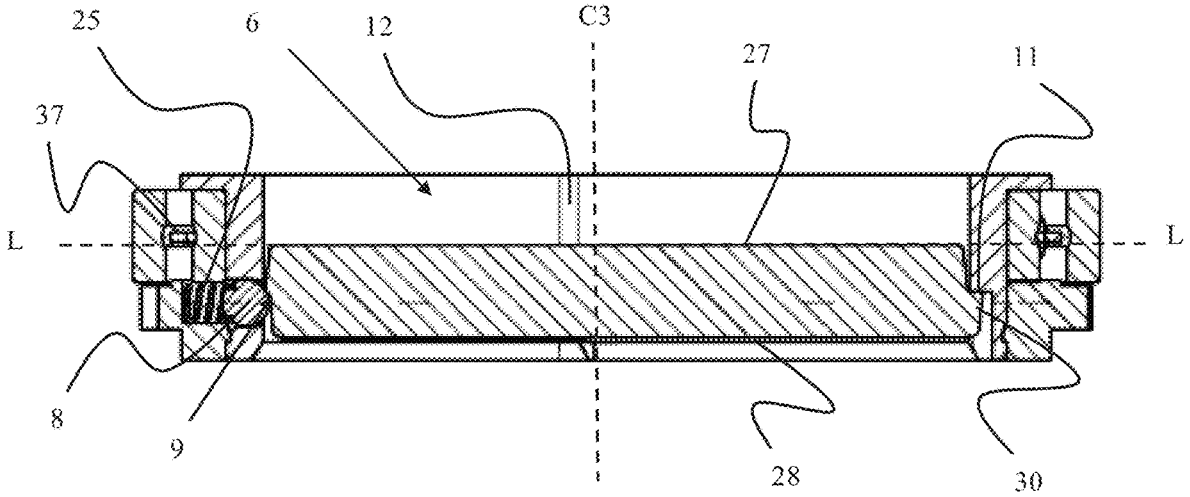
FIG. 7 is a cross-sectional side view of the cartridge holder in FIG. 4, according to some embodiments.
Figure 8:
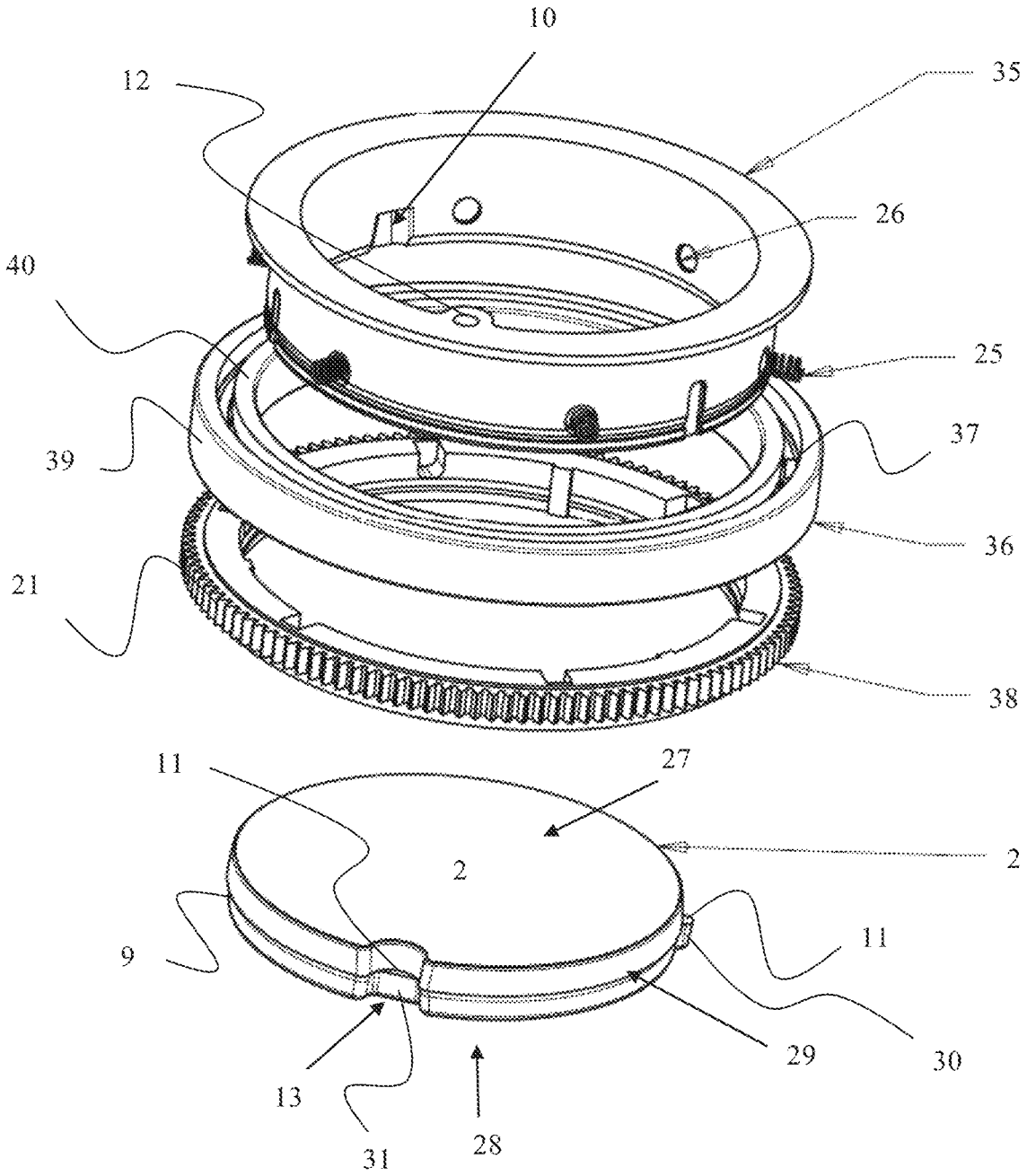
FIG. 8 is an exploded view of the cartridge holder in FIG. 4, according to some embodiments.

The processing cartridge 2, see FIGS. 6-8, comprises an upper face 27, a lower face 28 and a circumferential side wall 29 defining a disc-shaped body. The circumferential side wall comprises a locking surface 9 (i.e. at least one first abutting surface) and multiple stopping surfaces 11 (i.e. at least one second abutting surface). The locking surface 9 face away from the upper face 27 of the processing cartridge. In some embodiments, the locking surface is part of a lower section of the circumferential side wall 29 being angled relative to the centre axis (C3) of the cartridge. The multiple stopping surfaces face away from the lower face 28 and are arranged on top of two protrusions/ribs 30 in the circumferential side wall 29 and on a shoulder element 31 within the vertical recess 13. In some embodiments, the circumferential wall of the processing cartridge, as well as the inner wall of the cartridge holder, have a substantially circular cross-section. However, the circumferential wall of processing cartridge and the corresponding inner wall of the cartridge holder, may in some embodiments have any suitable cross-section, such as rectangular, square or elliptic.

The inner side wall 7 comprises multiple balls 8 pretensioned by springs 25 (i.e. a resilient locking assembly comprising multiple resilient elements) for interaction with the cooperating locking surface 9 (i.e. the at least one first abutting surface) on the processing cartridge 2. The balls 8 are positioned at the same vertical level along the inner wall and extend through multiple corresponding openings 26 in the inner wall 7. Thus, when the processing cartridge is inserted into the passage 7, the balls 8 are initially pushed against their respective springs 25 allowing an upper section of the cartridge to pass (i.e. the cartridge is pushed with a force sufficient to overcome the elastic force provided by the springs). After passage of the upper section of the processing cartridge, the balls are forced by the respective springs to push against the locking surface 9 at the lower section. In order to hold the processing cartridge at a predetermined vertical level when accommodated in the cartridge holder, the cartridge holder comprises two recesses 10 arranged in the inner wall 7 and one recess (not shown) arranged in a vertical rib 12 (i.e. stopping elements). Each of the two recesses 10 in the inner wall interact with a respective stopping surface 11 arranged on one of the two ribs/protrusions 30 of the processing cartridge, while the recess in the vertical rib 12 interacts with the shoulder element 31 in the recess 13 of the processing cartridge. In this manner, the processing cartridge may be inserted into the cartridge holder and releasably secured at a predetermined level. During processing of a processing cartridge in a dual axis centrifuge apparatus, the processing cartridge is subjected to high G-forces and fast changes in rotation around its centre axis C2. To obtain reproducible results of high accuracy, the vertical level of the processing cartridge should be kept at a predetermined level at all times. An advantage of the present cartridge holder comprising a resilient locking assembly and stopping elements is that the processing cartridge is securely and releasably held at a predetermined vertical level throughout the processing. A further advantage of having the locking surface 9 and the stopping surfaces 11 arranged on the circumferential side wall of the processing cartridge is that the whole upper and lower face of the cartridge is visible to optical readout analysis and control systems 22, 23, allowing maximum utilization of the cartridge volume and a superior flexibility when designing a required fluid circuit 16.

The cartridge holder 15 of FIGS. 4-8 comprises three main ring-shaped elements, a first element 35 (i.e. a first cartridge holder element) comprising the inner wall 7, a second element 36 comprising a ball bearing 37, and a third element 38 comprising the gear 21. The second element have an outer section 39 rigidly connected to, or embedded in, the rotary plate 3 and an inner section 40 rigidly connected to the first element and the third element. Thus, when the third element is rotated by interaction between the gear 21 and the intermediate gear assembly 20, the first element rotates relative the rotary plate 3.

The cartridge holder and the processing cartridge according to the disclosure is described by reference to some embodiments as disclosed in FIGS. 4-8. However, other types of resilient locking assemblies and stopping elements suitable for use in a cartridge holder having a through-going passage 6, as well as corresponding locking surfaces and stopping surfaces on a processing cartridge, would be obvious to the skilled person based on the teachings of the present specification. Alternative locking assemblies may for instance comprise any type of suitable resilient clip fasteners etc. arranged in or on the inner wall for direct interaction with locking surfaces on the processing cartridge. Further, in some embodiments, the cartridge holder may comprise a locking assembly and stopping element suitable for interaction with a processing cartridge, wherein the locking and stopping surfaces are a section of the lower and upper face of the processing cartridge, respectively.

The design of the cartridge holder, in particular the combination of a through-going passage and the resilient locking assembly, allows for a highly advantageous automatic loading and/or ejection of a processing cartridge into/out of the cartridge holder.

During use, the processing cartridge is inserted into the centrifuge apparatus via a cartridge loading tray 24 (shown in FIG. 1 in the closed position). The cartridge loading tray is substantially similar to a common CD loading tray. The tray is arranged to accommodate a processing cartridge 2 and comprises a central opening (not shown) arranged below the processing cartridge arranged on the tray. When the cartridge loading tray is in the open position (not shown), an operator may place a processing cartridge 2 upon the cartridge loading tray 24 for subsequent insertion into the centrifuge apparatus (i.e. by moving the cartridge loading tray into the closed position). In the closed position, the processing cartridge may be arranged directly below one of the cartridge holders 15,15'. The centrifuge apparatus features a cartridge loading piston 32 for loading the processing cartridge into one of the cartridge holders 15, 15' and a cartridge ejection piston 33 for ejecting the processing cartridge out of one of the cartridge holders. The loading and ejection pistons are coaxially arranged on opposite sides of the cartridge loading tray and the rotary plate 3, and are controlled by a camshaft assembly 34. During loading of the processing cartridge, the loading piston 32 is moved vertically upwards to engage the lower face 28 of the processing cartridge and push the cartridge 2 into the passage 6 of the cartridge holder 15 from below. The loading piston 32 applies a force to the cartridge which is sufficient to overcome the elastic force of the resilient locking assembly. After processing, the processing cartridge is ejected from the cartridge holder 15 to the cartridge loading tray 24. To eject the cartridge, the ejection piston 33 is moved vertically downwards to engage the upper face 27 of the processing cartridge and pushes the cartridge into the tray. The ejection piston 33 applies a force to the cartridge 2 which is sufficient to overcome the elastic force of the resilient locking assembly 8, 25.

The present disclosure is described by reference to a specific mechanical camshaft assembly 34 for automatic loading/ejection of the cartridge 2 to/from the cartridge holder from a cartridge loading tray arranged below the cartridge holder. However, other solutions for obtaining an automatized loading/ejection of the cartridge 2 to/from the cartridge holder would be obvious for the skilled person based on the present disclosure.

The processing cartridge 2 comprises an internal fluidic or microfluidic circuit. A schematic fluidic circuit 16 is shown in the cartridges of FIGS. 1-3 for illustrative purposes. The fluidic circuit of the processing cartridge may be designed for processing a sample, for instance performing various types of analytical assays on a whole blood sample, or for processing various chemical reactions including polymerase chain reaction (PCR) and synthetic chemistry reactions. The cartridge may for instance include micro channels and a variety of fluidic cavities for handling, processing and transporting nL-quantities, μL-quantities and mL-quantities of various liquids. Further, the cartridge may be optically transparent or translucent. This allows studying of transportation of liquids, colour development, separations, etc. throughout the cartridge. The sample may be a fluidic sample (or a fluidized solid sample), a liquid, a blood sample, etc. Also, the cartridge may contain one or more reagents. Exemplary fluidic circuits that may be used in a processing cartridge suitable for the present centrifuge apparatus 1 is disclosed in for instance WO 2011/081530 A1, the content of which herein is incorporated by reference. Further, various methods that may be performed in such fluid circuits, as well as suitable fluid circuits, are disclosed in PCT/EP2015/063811, PCT/EP2015/063817 and PCT/EP2015/063824. Further, the processing cartridge will commonly comprise a port for introduction of a sample. However, in some instances, for instance if the processing cartridge is used for the manufacture of small quantities of chemicals/drugs having a short shelf life, the required reagents may be introduced during manufacture of the processing cartridge.

The invention claimed is:

1. A centrifuge apparatus for a processing cartridge comprising:

a rotary plate configured to rotate around its centre axis and comprising at least one cartridge holder, wherein the rotary plate has an upper face and a lower face, the at least one cartridge holder is configured to rotate around its centre axis, is arranged off-centre the centre axis of the rotary plate, and the at least one cartridge holder comprises an inner side wall surrounding a through-going passage, wherein the through-going passage is configured to accommodate the processing cartridge and extends from the upper face to the lower face of the rotary plate, and at least one stopping element configured to interact with at least one cooperating second abutting surface on the processing cartridge, the at least one stopping element being arranged to retain the processing cartridge at a desired vertical level when the cartridge is releasably secured, wherein the inner side wall comprises a resilient locking assembly for interaction with at least one cooperating first abutting surface on the processing cartridge, such that the processing cartridge is configured to be inserted into the through-going passage and releasably secured by the locking assembly, and wherein the cartridge holder is arranged such that the processing cartridge may enter the through-going passage from the lower face of the rotary plate, during use.

2. The centrifuge apparatus of claim 1, wherein the resilient locking assembly is arranged to push the at least one second abutting surface of an accommodated processing cartridge against the at least one stopping element.

3. The centrifuge apparatus of claim 1, wherein the inner side wall comprises at least one of a vertical rib or a recess for interaction with a cooperating recess or vertical rib, respectively, arranged at a circumferential side wall of the processing cartridge, such that the cartridge may only be introduced into the cartridge holder at a specific rotational direction relative a centre axis of the cartridge holder.

4. The centrifuge apparatus of claim 1, wherein the resilient locking assembly is for interaction with the first abutting surface when the first abutting surface is arranged on a circumferential side wall of the processing cartridge.

5. The centrifuge apparatus of claim 1, wherein the stopping element is for interaction with the second abutting surface when the second abutting surface is arranged on a circumferential side wall of the processing cartridge.

6. The centrifuge apparatus of claim 1, wherein the resilient locking assembly is biased towards a locking position, in which position an accommodated processing cartridge may be releasably secured.

7. The centrifuge apparatus of claim 1, wherein the resilient locking assembly comprises multiple resilient elements spaced around the inner side wall.

8. The centrifuge apparatus of claim 1, wherein the at least one stopping element comprises a recess in the inner side wall of the cartridge holder, wherein the recess extends from an edge portion of the side wall and one end of the recess being distal from the edge portion is for interaction with the second abutting surface.

9. The centrifuge apparatus of claim 3, wherein the inner side wall comprises vertical rib, for interaction with the cooperating recess arranged at the circumferential side wall of the processing cartridge, and the at least one stopping element comprises a recess in the vertical rib for interaction with the second abutting surface.

10. The centrifuge apparatus of claim 1, wherein a cartridge holder element comprises the inner wall of the cartridge holder.

11. A processing cartridge for a centrifuge apparatus comprising:

an upper face, a lower face, and a circumferential side wall, the circumferential side wall comprising a first surface facing away from the upper face and a second, third, and fourth surface facing away from the lower face, the first surface is part of a section of the circumferential side wall being inclined relative to the centre axis of the cartridge and the second surface and the third surface is arranged on each of two rib/protrusions at the circumferential side wall, wherein the circumferential side wall comprises a vertical recess extending from the lower face to the upper face, and the fourth surface is arranged on a shoulder of the vertical recess extending from the lower face to the upper face.

12. The processing cartridge of claim 11, wherein the upper face, the lower face, and the circumferential side wall defines a disc-shaped body.

13. The processing cartridge of claim 11, wherein an internal volume of the cartridge comprises a microfluidic processing circuit.

14. A method of loading a processing cartridge into a centrifuge apparatus comprising a cartridge holder, a cartridge loading tray and a cartridge loading piston, the method comprising:

loading a processing cartridge onto the cartridge loading tray;

moving the cartridge loading tray, such that the centreline of the processing cartridge is in line with the centreline of the cartridge holder; and moving the cartridge loading piston in an upwards vertical direction, such that the processing cartridge is pushed into the at least one cartridge holder from below, such that the processing cartridge is releasably secured in the cartridge holder.

15. The centrifuge apparatus of claim 7, wherein each of the resilient elements comprises a pretensioned ball arranged in the inner side wall.

16. The centrifuge apparatus of claim 8, wherein the at least one stopping element comprises at least two of said recesses spaced around the inner side wall.

* * * * *